US005246821A

United States Patent [19]

Abe et al.

[11] Patent Number: 5,246,821

[45] Date of Patent: Sep. 21, 1993

[54] BLEACHING SOLUTION FOR PROCESSING A SILVER HALIDE COLOR PHOTOGRAPHIC MATERIAL AND A PROCESSING METHOD USING THE SAME

[75] Inventors: Akira Abe; Hiroyuki Seki, both of Kanagawa, Japan

[73] Assignee: Fuji Photo Film Co., Ltd., Kanagawa, Japan

[21] Appl. No.: 841,543

[22] Filed: Feb. 26, 1992

[30] Foreign Application Priority Data

Feb. 28, 1991 [JP] Japan ..... 3-119607

[51] Int. Cl.[5] ..... G03C 7/42

[52] U.S. Cl. ..... 430/393; 430/430; 430/461

[58] Field of Search ..... 430/393, 430, 461

[56] References Cited

U.S. PATENT DOCUMENTS

| | | | |
|---|---|---|---|
| 4,524,129 | 6/1985 | Kishimoto et al. | 430/393 |
| 4,910,125 | 3/1990 | Haruuchi et al. | 430/430 |
| 5,061,608 | 10/1991 | Foster et al. | 430/430 |
| 5,068,170 | 11/1991 | Abe | 430/393 |

FOREIGN PATENT DOCUMENTS

| | | |
|---|---|---|
| 0329088 | 8/1989 | European Pat. Off. . |
| 0395442 | 10/1990 | European Pat. Off. . |
| 0412532 | 2/1991 | European Pat. Off. . |
| 2-282740 | 11/1990 | Japan . |
| 3-033847 | 2/1991 | Japan . |

OTHER PUBLICATIONS

World Patents Index Latest, Section PQ, Week 9101 Derwent Publications Ltd., London, GB; Class P83, AN 91-004594 & JP-A-2 282 740 (Fuji Photo Film Co., Ltd.) 20 Nov. 1990.

*Primary Examiner*—Hoa Van Le

*Attorney, Agent, or Firm*—Sughrue, Mion, Zinn, Macpeak & Seas

[57] ABSTRACT

A photographic bleaching solution for procesisng a silver halide color photographic material, comprising an iron(III) complex salt of an organic acid in a concentration of from 0.01 mol/l to less than 0.1 mol/l, at least 50 mol % of said iron(III) complex salt of an organic acid contained in the bleaching solution is an iron(III) complex salt of an organic acid having an oxidation-reduction potential of not lower than 200 mV determined by using a normal hydrogen electrode at pH 5.0 (excluding iron(III) complex salts of iminodiacetic acid and iron(III) complex salts of methyliminodiacetic acid), and an acid having a pKa of from 2 to 5.5 (excluding aminopolycarboxylic acids, salts thereof and iron complex salts of the aminopolycarboxylic acids) in a concentration of from 0.1 mol/l to 0.8 mol/l, and the concentration of ammonium ion in the bleaching solution is not higher than 0.3 mol/l. A method for processing a silver halide color photographic material using said bleaching solution.

15 Claims, No Drawings

BLEACHING SOLUTION FOR PROCESSING A SILVER HALIDE COLOR PHOTOGRAPHIC MATERIAL AND A PROCESSING METHOD USING THE SAME

FIELD OF THE INVENTION

This invention relates to a bleaching solution for processing silver halide color photographic materials (hereinafter also referred to as light-sensitive materials), and a method for processing silver halide color photographic materials with said bleaching solution. More particularly, the present invention relates to a processing solution which provides improved image fastness of light-sensitive after processing, allows for the maintenance of processors to be simplified, reduces environmental pollution and exhibits rapid bleaching performance. The present invention also relates to a processing method using bleaching solution.

BACKGROUND OF THE INVENTION

Silver halide color photographic materials are generally processed with a bleaching solution, etc. after color development. With an increase in the processing of the photographic materials in miniature shop laboratories, there has been an increased demand for rapid processing in recent years. The development of a rapid technique for the bleaching stage has been investigated to meet this demand.

Typical techniques include methods wherein an oxidizing agent having an oxidation-reduction potential of not lower than 150 mV at a pH of 6 such as the iron(III) complex salt of 1,3-diamino-propanetetraacetic acid is used in combination with an acid having a pKa of 2 to 5 in an amount of at least 1.2 mol/l, or a nitrate in an amount of at least 0.5 mol/l. In this manner, rapid bleaching is achieved while preventing bleach fog or preventing an increase in stain during storage after processing as disclosed in JP-A-2-282740 (the term "JP-A" as used herein means an "unexamined published Japanese patent application"), JP-A-2-282741, JP-A-3-33847, and European Patent 427,204A.

It is noted that in each of the above-described patent specifications, an acid having a pKa of 2 to 5 is preferably used in an amount of at least 1.2 mol/l in order to prevent bleach fog.

Furthermore, the above-described patent specifications disclose that when the concentration of the iron(III) complex salt of an aminopolycarboxylic acid having an oxidation-reduction potential of not lower than 150 mV is less than 0.1 mol/l, bleaching is rapidly retarded. Hence it is preferred that the iron(III) complex salt is used in an an amount of not less than 0.1 mol/l, and the iron(III) complex salt is preferably used in the form of an ammonium salt to promote rapid bleaching.

For this reason, the iron(III) complex salt is used in the form of an ammonium salt in the bleaching solutions in the examples of the above described patent specifications. Particularly, ammonium 1,3-diamino-propanetetraacetato ferrate (ammonium 1,3-propylenediaminetetraacetato ferrate) is exemplified. In addition thereto, ammonium bromide, ammonium nitrate, ammonium thiosulfate, ammonium sulfite and ammonium water are formed, and the combined concentration of ammonium ion is at least 1.5 mol/l.

The present inventors have studied the above-described methods and have found that these methods are disadvantageous in the following three aspects.

A first problem is that in light-sensitive materials processed with the methods described above, the fastness of yellow dyes to light is reduced. The present inventors have experimentally found that fastness to light of fluorescent lamps is remarkably poor in comparison with light-sensitive materials processed with conventional methods requiring a long time of period using bleaching agents having an oxidation-reduction potential of not higher than 150 mV.

A second problem is that the bleaching solution travels upwardly along the inner walls of the tank in a processor containing the bleaching solution, and a large amount of a crystal is deposited on the surface or edges of the walls of the tank. The present inventors have found that the deposited crystal when brought into contact with the light-sensitive material during processing damages the light-sensitive material. Furthermore, the deposited crystal damages the smooth driving of the component parts of the processor and stains the processor, thereby increasing required maintenance for cleaning of the processor.

A third problem is that such bleaching solutions are highly corrosive to metals.

The processors are typically fabricated of metallic parts, which metallic parts are employed in various portions of the processor. Generally, stainless steel SUS316 is used for parts, which are brought into contact with the processing solution, taking resistance to corrosion of the stainless steel into consideration. However, the present inventors have found that the bleaching solutions described above corrode the parts in a short period of time, and stainless steel tanks, racks and roller shafts became damaged. Parts made of titanium are advantageously used with such bleaching solutions. However, titanous parts are expensive.

SUMMARY OF THE INVENTION

Accordingly, an object of the present invention is to provide a bleaching solution which does not reduce the fastness of a yellow dye image to light and which enables rapid processing , and a processing method using the bleaching solution.

Another object of the present invention is to provide a bleaching solution which does not result in deposition of crystal in the processing tank of the processor and which enables rapid processing, and a processing method using the bleaching solution.

Still another object of the present invention is to provide a bleaching solution which is substantially not corrosive to metal to thereby allow even parts made of stainless steel SUS316 to be used and which enables rapid processing, and a processing method using the bleaching solution.

With the recent emphasis on protecting the environment, there has been a demand to develop a treating agent which considerably reduces environmental pollution.

Accordingly, a further object of the present invention is to provide a bleaching agent which substantially does not result in the discharge of environmental pollutants and enables rapid processing, and a processing method using the bleaching solution.

The above-described objects of the present invention have been achieved by the following bleaching solution and processing method using the bleaching solution.

(1) A photographic bleaching solution for processing a silver halide color photographic material, comprising (i) an iron(III) complex salt of an organic acid in a concentration of from 0.01 mol/l to less than 0.1 mol/l, at least 50 mol % of said iron(III) complex salt of an organic acid contained in the bleaching solution is an iron(III) complex salt of an organic acid having an oxidation-reduction potential of not lower than 200 mV determined by using a normal hydrogen electrode at pH 5.0 (excluding iron(III) complex salts of iminodiacetic acid and those of methyliminodiacetic acid), and (ii) an acid having a pKa of from 2 to 5.5 (excluding aminopolycarboxylic acids, salts thereof and iron complex salts of the aminopolycarboxylic acids) in a concentration of from 0.1 mol/l to 0.8 mol/l, and wherein the concentration of ammonium ion in the bleaching solution is not higher than 0.3 mol/l.

(2) A method for processing an imagewise exposed silver halide color photographic material, comprising developing in a color developing solution and bleaching in the bleaching solution as described in (1) above.

DETAILED DESCRIPTION OF THE INVENTION

The present invention is illustrated in greater detail below.

The term "oxidation-reduction potential" as used herein refers to a value obtained by measuring the oxidation-reduction potential at a pH of 5 according to the method described in *Transactions of the Faraday Society*, Vol. 55, pp. 1312-1313 (1959). The oxidation-reduction potential is measured with a normal hydrogen electrode using a 0.01 mmol/l aqueous solution of the iron(III) complex salt (obtained by using 0.01 mol/l of each of an organic acid and an iron(III) salt) under conditions of pH of 5.0, a temperature of 25° C. and the molar ratio of the metal salt and the organic acid is 1:1.

The reason why the pH in the measurement of the oxidation-reduction potential is set to 5 is that the present inventors have found that the effects of the present invention corresponds to the measured value at a pH of 5, and the effect of the present invention corresponds not always to the oxidation-reduction potential obtained by measuring it at other pH value.

In reference to the above definition, the oxidation-reduction potential of the iron(III) complex salt of an organic acid for use in the present invention is not lower than 200 mV. When the oxidation-reduction potential is less than 200 mV, the bleaching ability is not sufficient. The oxidation-reduction potential is preferably from 240 mV to 400 mV, particularly preferably from 260 mV to 350 mV in order to provide rapid bleaching. An oxidation-reduction potential of higher than 400 mV is less preferred because there can be seen tendency of formation of bleach fog.

The concentration of the iron(III) complex salt of an organic acid contained in the bleaching solution having a bleaching power of the present invention is not less than 0.01 mol/l and is less than 0.1 mol/l. When the concentration is less than 0.01 mol/l, the bleaching rate is not sufficient. The concentration is preferably not higher than 0.08 mol/l, and particularly preferably from 0.03 mol/l to 0.06 mol/l to provide a stable bleaching rate and to provide a bleaching solution which is not corrosive and which maintaines light fastness of the images even though a color developing solution carried over from the preceeding bath is mixed therewith. When the concentration exceeds 0.1 mol/l the light fastness is deteriorated, the crystal deposites and the solution is corrosive to a metal.

At least 50 mol % of the iron(III) complex salt of an organic acid contained in the bleaching solution at the concentration described above must be an iron(III) complex salt of an organic acid having an oxidation-reduction potential of not lower than 200 mV. When the iron(III) complex salt of an organic acid having an oxidation-reduction potential of not lower than 200 mV is less than 50 mol % the bleaching ability of the solution is not sufficient. Preferably at least 80 mol %, particularly preferably all of the iron (III) complex salt of an organic acid has an oxidation-reduction potential of not lower than 200 mV.

The iron(III) complex salt of iminodiacetic acid and the iron (III) complex salt of methyliminodiacetic acid do not exhibit the effects of the present invention even though the oxidation-reduction potential are 270 mV and 290 mV, respectively.

In the present invention, a preferred iron(III) complex salt of an organic acid having an oxidation-reduction potantial of not lower than 200 mV is that which comprises an organic acid having at least two nitrogen atoms per molecule.

The nitrogen atoms may be contained in the organic acid as a group containing a nitrogen atom, such as —$NH_2$, —NH—, —$CONH_2$, and —CONH—. The organic acid may contain a heterocyclic group containing at least two nitrogen atoms or contain at least two heterocyclic groups containing a nitrogen atom. The number of a carboxyl group in the organic acid and the number of the ligand in the complex salt are not limited in the present invention.

In the present invention, the iron(III) complex salt of an organic acid may be comprised at least two iron(III) salts and/or at least two organic acids. Furthermore, in the present invention a mixture of two or more of the iron(III) complex salts can be used in combination.

Preferred non-limiting examples of organic acids in the free form of the iron(III) complex salt of an organic acid of the present invention having an oxidation-reduction potential of not lower than 200 mV are given below. The oxidation-reduction potential of the complex salt of the organic acid with a ferric salt is also indicated below.

These organic acids may be combined with any ferric salt. In the present invention two or more of the iron(III) complex salts can be used in combination.

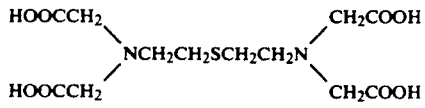

Compound 1

Oxidation-reduction potential: 230 mV

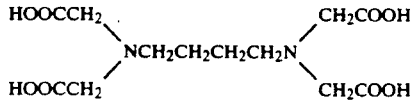

Compound 2

Oxidation-reduction potential: 238 mV
(disclosed in U.S. Pat. No. 4,963,474)

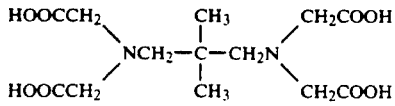

Compound 3

Oxidation-reduction potential: 225 mV

-continued

Compound 4

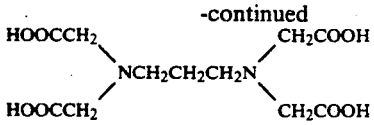

Oxidation-reduction potential: 255 mV
(disclosed in U.S. Pat. No. 4,963,474)

Compound 5

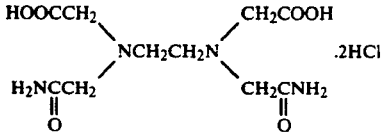

Oxidation-reduction potential: 280 mV

Compound 6

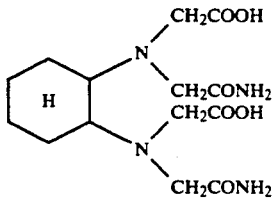

Oxidation-reduction potential: 285 mV

Compound 7

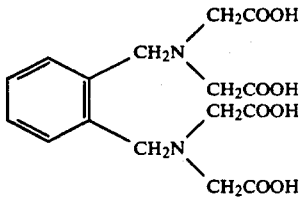

Oxidation-reduction potential: 315 mV

Compound 8

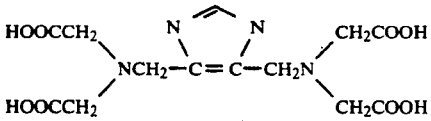

Oxidation-reduction potential: 358 mV

Compound 9

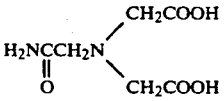

Oxidation-reduction potential: 225 mV

Compound 10

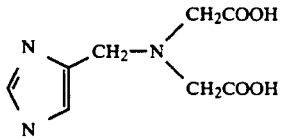

Oxidation-reduction potential: 220 mV

The above-exemplified compounds can be synthesized according to the methods described in *Chelate Chemistry*, Vol. 5, Chapter 1 by Kagehira Ueno (published by Nankodo, 1975).

A typical synthesis method for the compounds exemplified above is illustrated below.

SYNTHESIS EXAMPLE 1

Synthesis of Compound 5

In 200 ml of water was suspended 100 g (0.390 mol) of ethylenediaminetetraacetic anhydride (synthesis method being described in French Patent 1,548,888) while cooling with ice. To the resulting suspension was slowly added 98.0 g (0.811 mol) of 29% ammonia water at such a rate as to keep the internal temperature at 5° to 10° C. While cooling with ice was continued, the mixture was stirred for 1.5 hours and 86.0 g of 36% hydrochloric acid was added thereto. Furthermore one liter of ethanol was added thereto. The precipitated solid was recovered by filtration and recrystallized from water/ethanol to obtain 78.0 g (0.215 mol) of the desired compound 5. Yield: 55%. Melting point: 145°-147° C. (decomposition).

SYNTHESIS EXAMPLE 2

Synthesis of Compound 7

The following compounds (1) and (2) were synthesized as intermediates to prepare compound 7.

Compound (1)

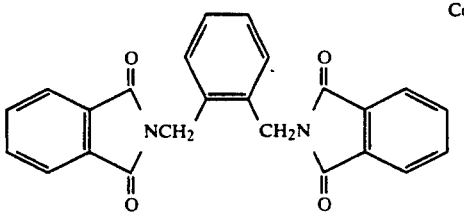

Compound (2)

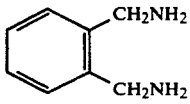

Synthesis of Compound (1)

In 1.5 l of dimethylformamide were dissolved 134 g (0.507 mol) of α, α'-dibromo-o-xylene and 210 g (1.13 mol) of potassium salts of phthalimide. The mixture was stirred with heating at 80° C. for 2 hours and 2 l of water was then added thereto. The mixture was stirred for an additional 2 hours. The precipitated solid was recovered by filtration, washed with water and dried with blown air to obtain 191 g (0.482 mol) of compound (1). Yield: 95%.

Synthesis of Compound (2)

In one liter of methanol were dissolved 173 g (0.436 mol) of compound (1) obtained above and 60.0 g (1.20 mol) of hydrazine monohydrate. The mixture was heated under reflux for 3 hours. The precipitated solids were recovered by filtration. The filtrate was concentrated under reduced pressure and then 122 g (1.20 mol) of concentrated hydrochloric acid was added thereto. While the mixture was stirred at room temperature, 500 ml of acetonitrile was added thereto. The precipitated solid was recovered by filtration, washed with acetonitrile and dried to obtain 169 g (0.809 mol) of compound (2). Yield: 95%.

Synthesis of Compound 7

In 100 ml of water was dissolved 59.9 g (0.286 mol) of compound (2) obtained above. To the resulting solution was added 22.9 g (0.573 mol) of sodium hydroxide. Further, 200 ml of an aqueous solution of 140 g (1.20 mol) of sodium chloroacetate and 100 ml of an aqueous solution of 48.0 g (1.20 mol) of sodium hydroxide were gradually added thereto while the reaction temperature was kept at 50° to 55° C. The addition was controlled such that when a small amount of phenolphthalein was added as a pH indicator thereto, a pale red color was formed. After the mixture was stirred with heating for an additional one hour, the mixture was left to stand to cool it. Subsequently, 122 g (1.20 mol) of concentrated hydrochloric acid was added thereto. The precipitated solid was recovered by filtration and dissolved in 600 ml of an aqueous solution of 45.6 g (1.14 mol) of sodium hydroxide. The resulting solution was filtered, and 116 g (1.14 mol) of concentrated hydrochloric acid was added to the filtrate. The precipitated white crystal was recovered by filtration, thoroughly washed with water and dried with blown air to obtain 75.1 g (0.204 mol) of the desired compound 7. Yield: 71%. Melting point: 247°-249° C. with decomposition.

Compound 9 can be commercially obtained, for example, as a product ADA (trade name) manufactured by Dojin Chemical Laboratory.

The above cited JP-A-2-282740 discloses that when the concentration of the iron(III) complex salt of an organic acid (Compound 4) is reduced to less than 0.1 mol/l, bleaching is suddenly retarded.

However, the present inventors have unexpectedly discovered that even though the concentration of the iron(III) complex salt of an organic acid is less than 0.1 mol/l, the bleaching rate is not reduced, bleach fog is not formed and the desired rapid processing is provided when the iron(III) complex salt of an organic acid defined above is used, and the bleaching solution further contains an acid having a pKa of from 2 to 5.5 (used as a pH buffering agent) in a concentration of from 0.1 to 0.8 mol/l. The pKa should be within the range of from 2 to 5.5 in order to make the pH of the solution to be within the range of 3 to 5.5.

The present inventors consider that the unexpected effects of this invention arise due to the fact that when the iron(III) complex salt of an organic acid and the acid having a pKa of 2 to 5.5 as the buffering agent are diluted, the film of an emulsion layer treated therein tends to swell. As a result, the diffusion rate of the iron(III) complex salt of an organic acid in the emulsion layer is improved, to thereby compensate for reduction in the bleaching rate due to reduced concentration of the bleaching agent.

Furthermore the present inventors have discovered that when the concentration of ammonium ion (introduced to the solution by incorporating $NH_4Br$, aqueous ammonia or an iron(III) complex ammonium salt of an organic acid into the solution) in the bleaching solution is not more than 0.3 mol/l (preferably not more than 0.1 mol/l), problems with regard to deposition of the crystal and the corrosion of metals caused by traveling of the bleaching solution upwardly along the inner walls of the processing tank are remarkably improved.

Additionally, the present inventors have discovered that the bleaching rate of the iron(III) complex salt of an organic acid remains high even when the bleaching solution is diluted, irrespective of whether compounds used are in the form of an ammonium salt or not. The present invention has been accomplished on the basis of these findings.

Iron(III) complex salts of an organic acid other than those defined in the present invention may be present in the bleaching solution of the present invention in an amount of less than 50 mol % of the entire content of the iron(III) complex salts of organic acids in the bleaching solution. Examples thereof include iron(III) complex salts of organic acids include (ethylenediaminetetraacetato) iron(III) complex salts, (diethylenetriaminetetraacetato) iron(III) complex salts, (cyclohexanediaminetetraacetato) iron(III) complex salts, iron(III) complex salts of iminodiacetic acid, iron(III) complex salts of methyliminodiacetic acid and iron(III) complex salts of nitrilotriacetic acid.

Examples of the acid having a pKa of from 2 to 5.5 for use in the present invention include the compounds described in JP-A-3-33847 (right lower column, line 8 of page 5 to right upper column, line 6 of page 6).

In the present invention the value of pKa is a logarithmic value of the reciprocal of the acid dissociation constant measured at conditions of an ionic strength of 0.1 mol/l and 25° C.

Examples of acids having a pKa of 2.0 to 5.5 include inorganic acids such as phosphoric acid and organic acids such as acetic acid, malonic acid, citric acid, etc. The acid having a pKa of 2.0 to 5.5 and which exhibits effects by the above-described improvements is an organic acid. Among organic acids those which have a carboxyl group are especially preferred.

The organic acid having a pKa of 2.0 to 5.5 may be either a monobasic acid or a polybasic acid. When the pKa of a polybasic acid is within the range of 2.0 to 5.5, the acid may be used as a metal salt (such as a sodium salt and a potassium salt) or an ammonium salt. Two or more of the organic acids having a pKa of 2.0 to 5.5 may be used in combination. Aminopolycarboxylic acids and iron complex salts thereof are excluded from the organic acids having pKa of from 2.0 to 5.5.

Preferred examples of organic acids having a pKa of 2.0 to 5.5 and which can be used in the present invention include aliphatic monobasic acids, for example, formic acid, acetic acid, monochloroacetic acid, monobromoacetic acid, glycolic acid, propionic acid, monochloropropionic acid, lactic acic, pyruvic acid, acrylic acid, butyric acid, isobutyric acid, pivalic acid, valeric acid, and isovaleric acid; aromatic monobasic acids, for example, benzoic acid, benzoic acids monosubstituted with a chlorine atom or a hydroxyl group, and nicotinic acid; aliphatic dibasic acids, for example, oxalic acid, malonic acid, succinic acid, tartaric acid, malic acid, maleic acid, fumaric acid, oxalacetic acid, glutaric acid, and adipic acid; ascorbic acid; aromatic dibasic acids, for example, phthalic acid and telephthalic acid; and polybasic acids, for example, citric acid.

Among them, acetic acid, glycolic acid and lactic acid are especially preferred.

The above described acids function mainly as pH buffering agents. The concentration of the acid having a pKa of 2 to 5.5 in the bleaching solution is from 0.1 mol/l to 0.8 mol/l, preferably from 0.1 mol/l to 0.5 mol/l, and particularly preferably from 0.1 mol/l to 0.3 mol/l. When the concentration of the acid exceeds 0.8 mol/l, the bleaching rate is greatly reduced, on the other hand, when the concentration is less than 0.1 mol/l, bleach fog is increased.

The concentration of ammonium ion in the bleaching solution of the present invention is not higher than 0.3 mol/l, and preferably not higher than 0.1 mol/l. Most preferably the bleaching solution is completely free from ammonium ion.

As the concentration of ammonium ion is decreased, the amount of crystal deposit caused by traveling of the bleaching solution upwardly along the inner walls of the bleach processing tank is deceased. Furthermore, the corrosion of metals is reduced thereby preferred processing can be carried out.

The amounts of the iron(III) complex salt of an organic acid as well as ammonium ion permitted to be discharged are presently restricted as environmental pollutants. Accordingly, for preservation of the environment, the amounts of these discharged pollutants are preferably minimized.

It is preferred that compounds are used in the form of an alkali metal salt such as a sodium or potassium salt to reduce the concentration of ammonium ion to a value within the scope of the present invention. More particularly, the sodium or potassium salts of the iron(III) complexes of organic acids, potassium bromide, sodium bromide, potassium nitrate and sodium nitrate are preferably used.

Potassium hydroxide or sodium hydroxide is preferably used in place of ammonia water to adjust pH.

Ammonium salt is conventionally used in the bleaching solution because the solubility in addition to rapid processing is improved. However, when a dilute bleaching solution containing an iron(III) complex salt of an organic acid in an amount of less than 0.1 mol/l is used in accordance with the present invention, compounds in the form of an alkali metal salt can be completely dissolved.

From the viewpoint of ensuring rapid processing and preventing bleach fog, the bleaching solution of the present invention has a pH of 3.0 to 5.5, preferably 3.5 to 5.0, more preferably 4.0 to 5.0.

The processing time with the bleaching solution of the present invention is preferably from 10 seconds to 5 minutes. For rapid processing, the processing time is preferably 3 minutes or less.

A remarkable improvement in fastness of yellow dye images to light is achieved by using the bleaching solution of the present invention, especially when the processing time after completion of bleaching is reduced. Specifically, the improvement is pronounced when the processing time after completion of bleacing to the completion of wet processing (i.e., prior to drying) is 10 minutes or less, particularly 8 minutes or less.

The bleaching solution of the present invention is preferably aerated during the course of processing.

It is particularly important that the bleaching ability of the bleaching solution of the present invention is always recovered by air oxidation because of the dilute concentration of the iron(III) complex salt of an organic acid. Aeration can be carried out by conventional means in the art. For example, air can be blown into the bleaching solution, or air can be absorbed into the bleaching solution by using an ejector.

Air blown into the bleaching solution is preferably blown through an air diffusion pipe having fine pores. Such air diffusion pipes are widely used for exposure tanks in the activated sludge process.

Aeration is described in Z-121, Using Process C-41, Third edition (1982), pp. BL-1-BL-2, published by Eastman Kodak Co.

The stirring (agitation) is preferably intensified in processing with the bleaching solution of the present invention. The techniques described in JP-A-3-33847 (right upper column, line 6 to left lower column, line 2 of page 8) or U.S. Pat. No. 5,068,170, column 12, lines 31 to 58 can be used for such intense stirring.

Particularly, a jet stirring system wherein the bleaching agent is jetted onto the emulsion surface of the light-sensitive material, is preferred. The processing temperature of the bleaching solution of the present invention is preferably 25° to 50° C., particularly preferably 35° to 45° C., although there is no particular limitation with regard to the processing temperature.

The replenishment rate of the bleaching solution of the present invention is preferably 50 to 1000 ml, more preferably 60 to 600 ml per $m^2$ of the light-sensitive material processed.

The bleaching solution of the present invention can be re-used by recovering an overflow solution after processing and adding necessary ingredients to correct the composition thereof. Such reuse is generally called regeneration, and regeneration is preferably conducted in the present invention. The details of the regeneration are described in *Fuji Film Processing Manual, Fuji Color Negative Film, CN-16 Processing* (a revised edition, August 1990) pp. 39–40, published by Fuji Photo Film Co., Ltd.

Kits for preparing the bleaching solution of the present invention may be in any form of a liquid or a powder. However, when ammonium salt is omitted, most of the raw materials are supplied in the form of powders, and since the raw materials are less hydroscopic, kit can be easily prepared in the form of powder.

Furthermore, in order to reduce the amount of waste liquor to be discharged kids for regeneration are preferably in a form of powder, since the powder can be added directly to the solution without using extra water.

Compounds conventionally used for bleaching solutions can be added to the bleaching solution of the present invention. Examples of such additives include bleaching accelerators, rehalogenating agents and metal corrosion inhibitors as described in JP-A-3-33847 (right upper column, line 15 of page 6 to right lower column, line 4 of page 6) or U.S. Pat. No. 5,068,170, column 10, lines 14 to 47. The use of a bleaching accelerator is particularly preferred. Disulfide compounds, mercaptotriazoles, mercaptothiadiazoles, diethylaminoethanethiols and monothioglycerols as described in JP-A-53-95630 preferably are directly added to the bleaching solution or are added to a prebath thereof to provide a bleach accelerating effect.

In addition, dispersants such as polyvinylpyrrolidone and polyvinyl alcohol can be added to the bleaching solution.

In the present invention, the iron(III) complex salt of an organic acid is readily obtained by separately adding an organic acid and a ferric salt to form a complex in the bleaching solution. The molar ratio of the organic acid to the ferric salt is preferably not less than 1.0 (preferably not more than 4.0, and more preferably not more than 2.0), and usually the organic acid is added to the solution prior to the addition of the ferric salt. Preferred examples of the ferric salt include ferric chloride, ferric sulfate and ferric bromide.

Alternatively, the bleaching solution can be prepared by adding thereto a previously prepared iron(III) complex salt of an organic acid which dissolves in the bleaching solution without difficulty.

Color developing solutions preferably used in the present invention include those described in JP-A-3-33847 (left upper column, line 6 of page 9 to right lower column, line 6 of page 11) or U.S. Pat. No. 4,963,474, column 31, line 1 to column 33, line 54.

Specifically, color developing solutions CN-16 and CN-16Q for processing color negative films and replenishers for color developing solutions manufactured by Fuji Photo Film Co., Ltd. and color developing solutions C-41, C-41B and C-41RA for processing color negative films manufactured by Eastman Kodak Co. are preferably used.

Light-sensitive materials which are processed with the bleaching agent in the present invention are subjected to fixing or bleach-fixing treatment.

The fixing solutions and bleaching-fixing solutions as described in JP-A-3-33847 (right lower column, line 16 to left upper column, line 15 of page 8) or U.S. Pat. No. 5,068,170, column 10, line 48 to column 13, line 5 are preferably used for the fixing or bleaching-fixing treatment. These treatments are preferably conducted under conditions of a pH of from 6.5 to 7.5 and a temperature of from 35° to 45° C. for from 1 to 5 minutes.

Examples of the desilverization stage comprising bleaching and fixing include the following:

Bleaching—fixing
Bleaching—rinsing—fixing
Bleaching—bleach-fixing
Bleaching—rinsing—bleach-fixing
Bleaching—bleach-fixing—fixing Stirring is preferably intensified in the fixing stage or the bleach-fixing stage as well as in the bleaching stage. Particularly, the above described jet stirring system is most preferred.

The replenishment rate of the fixing solution or the bleach-fixing solution can be reduced by removing silver from the fixing solution or the bleach-fixing solution in a conventional manner. Furthermore, the bleaching solution or the bleach-fixing solution can be re-used by removing silver therefrom in a conventional manner.

The rinsing and stabilization stages for use in the present invention are preferably carried out according to the methods described in JP-A-3-33847 (right lower column, line 9 of page 11 to right upper column, line 19 of page 12) or U.S. Pat. No. 5,068,170, column 13, lines 6 to 52.

The stabilization solution of the present invention can contain formaldehyde as a stabilizing agent. However, it is preferred from the viewpoint of safety on working atmosphere that precursors for formaldehyde such as N-methylol-pyrazole, hexamethylenetetramine, formaldehyde-bisulfite adduct and dimethylol urea are used. Among them, N-methylol-pyrazole obtained by the reaction of formaldehyde with pyrazole is preferred for providing high image stability.

The bleaching solution and processing method of the present invention can be applied to various color light-sensitive materials such as color negative films, reversal color films, color paper, reversal color paper, movie color negative films and movie color positive films. Particularly, the bleaching solution and processing method of the present invention are preferably applied to the light-sensitive materials described in JP-A-3-33847 (right upper column, line 20 page 12 to right upper column, line 17 of page 17) or U.S. Pat. No. 5,068,170, column 14, line 7 to column 19, line 48. Especially preferred are light-sensitive materials containing silver halide such as silver bromoiodide, silver chloroiodide and silver bromochloroiodide each containing silver iodide in an amount of from 0.1 to 30 mol % (preferably from 2 to 25 mol %). Light-sensitive materials having a dry layer thickness of not more than 20 μm, particularly not more than 18 μm are preferably processed in accordance with the present invention.

Furthermore, a high swelling rate of the photographic material for processing in the present invention is preferable. Particularly, the swelling rate described in JP-A-3-33847 (left upper column, lines 7 to 14 of page 14) or U.S. Pat. No. 5,068,170, column 16, lines 15 to 28 is particularly preferred.

The present invention is illustrated below in greater detail by reference to the following examples which, however, are not to be construed as limiting the present invention in any way.

EXAMPLE 1

The surface of an undercoated cellulose triacetate film support was coated with the following layers having the compositions as set forth below to prepare a multi-layer color light-sensitive material designated as sample 101. The material was cut into specimens of 35 mm in width, exposed (overall exposure) to light of 5 CMS at a color temperature of 4800 K and processed in a cine system automatic processor using the processing stages and processing solutions described below. Bleaching solutions 1 to 13 including comparative bleaching solutions and those of the invention were prepared, and processing was carried out by replacing the bleaching solutions with one another in turn.

Composition of Photographic Layers

The unit for each ingredient represents a coating weight in g/m². The amount of silver halide in the emulsion is given by coating weight in terms of silver in silver halide. The amount of each sensitizing dye is given in terms of moles per mole of silver halide in the same layer.

| | | |
|---|---|---|
| First layer (antihalation layer) | | |
| Black colloidal silver | (in terms of silver) | 0.18 |
| Gelatin | | 1.40 |
| Second layer (interlayer) | | |
| 2,5-Di-t-pentadecylhydroquinone | | 0.18 |
| EX-1 | | 0.18 |
| Ex-3 | | 0.020 |
| EX-12 | | $2.0 \times 10^{-3}$ |
| U-1 | | 0.060 |
| U-2 | | 0.080 |
| U-3 | | 0.10 |
| HBS-1 | | 0.10 |
| HBS-2 | | 0.020 |
| Gelatin | | 1.04 |
| Third layer (first red-sensitive emulsion layer) | | |
| Silver halide in Emulsion A | (in terms of silver) | 0.25 |
| Silver halide in Emulsion B | (in terms of silver) | 0.25 |
| Sensitizing dye I | | $6.9 \times 10^{-5}$ |
| Sensitizing dye II | | $1.8 \times 10^{-5}$ |
| Sensitizing dye III | | $3.1 \times 10^{-4}$ |
| EX-2 | | 0.17 |
| Ex-10 | | 0.020 |
| EX-14 | | 0.17 |
| U-1 | | 0.070 |
| U-2 | | 0.050 |
| U-3 | | 0.070 |
| HBS-1 | | 0.060 |
| Gelatin | | 0.87 |
| Fourth layer (second red-sensitive emulsion layer) | | |
| Silver halide in Emulsion G | (in terms of silver) | 1.00 |
| Sensitizing dye I | | $5.1 \times 10^{-5}$ |
| Sensitizing dye II | | $1.4 \times 10^{-5}$ |
| Sensitizing dye III | | $2.3 \times 10^{-4}$ |
| EX-2 | | 0.20 |
| EX-3 | | 0.050 |
| Ex-10 | | 0.015 |
| EX-14 | | 0.20 |
| U-1 | | 0.070 |
| U-2 | | 0.050 |
| U-3 | | 0.070 |
| Gelatin | | 1.30 |
| Fifth layer (third red-sensitive emulsion layer) | | |
| Silver halide in Emulsion D | (in terms of silver) | 1.60 |
| Sensitizing dye I | | $5.4 \times 10^{-5}$ |
| Sensitizing dye II | | $1.4 \times 10^{-5}$ |
| Sensitizing dye III | | $2.4 \times 10^{-4}$ |
| EX-2 | | 0.097 |

-continued

| | | |
|---|---|---|
| Ex-3 | | 0.010 |
| EX-4 | | 0.080 |
| EX-15 | | 0.01 |
| HBS-1 | | 0.22 |
| HBS-2 | | 0.10 |
| Gelatin | | 1.63 |
| Sixth layer (interlayer) | | |
| EX-5 | | 0.040 |
| HBS-1 | | 0.020 |
| Gelatin | | 0.80 |
| Seventh layer (first green-sensitive emulsion layer) | | |
| Silver halide in Emulsion A | (in terms of silver) | 0.15 |
| Silver halide in Emulsion B | (in terms of silver) | 0.15 |
| Sensitizing dye IV | | $3.0 \times 10^{-5}$ |
| Sensitizing dye V | | $1.0 \times 10^{-4}$ |
| Sensitizing dye VI | | $3.8 \times 10^{-4}$ |
| EX-1 | | 0.021 |
| EX-6 | | 0.26 |
| Ex-7 | | 0.030 |
| EX-8 | | 0.025 |
| HBS-1 | | 0.10 |
| HBS-3 | | 0.010 |
| Gelatin | | 0.63 |
| Eighth layer (second green-sensitive emulsion layer) | | |
| Silver halide in Emulsion C | (in terms of silver) | 0.45 |
| Sensitizing dye IV | | $2.1 \times 10^{-5}$ |
| Sensitizing dye V | | $7.0 \times 10^{-5}$ |
| Sensitizing dye VI | | $2.6 \times 10^{-4}$ |
| EX-6 | | 0.094 |
| Ex-7 | | 0.026 |
| EX-8 | | 0.018 |
| HBS-1 | | 0.16 |
| HBS-3 | | $8.0 \times 10^{-3}$ |
| Gelatin | | 0.50 |
| Ninth layer (third green-sensitive emulsion layer) | | |
| Silver halide in Emulsion C | (in terms of silver) | 1.20 |
| Sensitizing dye IV | | $3.5 \times 10^{-5}$ |
| Sensitizing dye V | | $8.0 \times 10^{-5}$ |
| Sensitizing dye VI | | $3.0 \times 10^{-4}$ |
| EX-1 | | 0.013 |
| EX-11 | | 0.065 |
| EX-13 | | 0.019 |
| HBS-1 | | 0.25 |
| HBS-2 | | 0.10 |
| Gelatin | | 1.54 |
| Tenth layer (yellow filter layer) | | |
| Yellow colloidal silver | (in terms of silver) | 0.050 |
| EX-5 | | 0.080 |
| HBS-1 | | 0.030 |
| Gelatin | | 0.95 |
| Eleventh layer (first blue-sensitive emulsion layer) | | |
| Silver halide in Emulsion A | (in terms of silver) | 0.080 |
| Silver halide in Emuslion B | (in terms of silver) | 0.070 |

-continued

| | | |
|---|---|---|
| Silver halide in Emulsion F | (in terms of silver) | 0.070 |
| Sensitizing dye VII | | $3.5 \times 10^{-4}$ |
| EX-8 | | 0.042 |
| EX-9 | | 0.72 |
| HBS-1 | | 0.28 |
| Gelatin | | 1.10 |
| Twelfth layer (second blue-sensitive emulsion layer) | | |
| Silver halide in Emulsion G | (in terms of silver) | 0.45 |
| Sensitizing dye VII | | $2.1 \times 10^{-4}$ |
| EX-9 | | 0.15 |
| EX-10 | | $7.0 \times 10^{-3}$ |
| HBS-1 | | 0.050 |
| Gelatin | | 0.78 |
| Thirteenth layer (third blue-sensitive emulsion layer) | | |
| Silver halide in Emulsion H | (in terms of silver) | 0.77 |
| Sensitizing dye VII | | $2.2 \times 10^{-4}$ |
| EX-9 | | 0.20 |
| HBS-1 | | 0.070 |
| Gelatin | | 0.69 |
| Fourteenth layer (first protective layer) | | |
| Silver halide in Emulsion I | (in terms of silver) | 0.20 |
| U-4 | | 0.11 |
| U-5 | | 0.17 |
| HBS-1 | | $5.0 \times 10^{-2}$ |
| Gelatin | | 1.00 |
| Fifteenth layer (second protective layer) | | |
| H-1 | | 0.40 |
| B-1 (diameter 1.7 μm) | | $5.0 \times 10^{-2}$ |
| B-2 (diameter 1.7 μm) | | 0.10 |
| B-3 | | 0.10 |
| S-2 | | 0.20 |
| Gelatin | | 1.20 |

Further, the light sensitive material contained W-1, W-2, W-3, B-4, B-5, F-1, F-2, F-3, F-4, F-5, F-6, F-7, F-8, F-9, F-10, F-11, F-12, F-13, iron salt, lead salt, gold salt, platinum salt and rhodium salt to improve preservability, processability, pressure resistance, bacilli-proofing and antifungal properties, antistatic properties and coatability.

The dry layer thickness of the sample 1 was 19.5 μm and the 50% swelling rate ($T_{\frac{1}{2}}$: the time to reach a half of the maximum swollen layer thickness) was 8 seconds in the developing solution under the conditions of Example 1.

Emulsions used herein were AgBrI emulsion.

TABLE 1

| Emulsion | Average AgI content (%) | Mean grain size (μm) | Coefficient of variation in grain size (%) | Ratio of diameter/thickness | Ratio of silver content (AgI content, %) |
|---|---|---|---|---|---|
| A | 4.0 | 0.45 | 27 | 1 | core/shell = 1/3 (13/1), double structure grains |
| B | 8.9 | 0.70 | 14 | 1 | core/shell = 3/7 (25/2), double structure grains |
| C | 10 | 0.75 | 30 | 2 | core/shell = 1/2 (24/3), double structure grains |
| D | 16 | 1.05 | 35 | 2 | core/shell = 4/6 (40/0), double structure grains |
| E | 10 | 1.05 | 35 | 3 | core/shell = 1/2 (24/3), double structure grains |
| F | 4.0 | 0.25 | 28 | 1 | core/shell = 1/3 (13/1), double structure grains |
| G | 14.0 | 0.75 | 25 | 2 | core/shell = 1/2 (42/0), double structure grains |
| H | 14.5 | 1.30 | 25 | 3 | core/shell = 37/63 (34/3), double structure grains |
| I | 1 | 0.07 | 15 | 1 | uniform grains |

Chemical formulae of the compounds which were used in Examples in the present invention are shown below. An alkyl group having not any symbol of n, t or i in the chemical formula represents a n-alkyl group.

EX-1
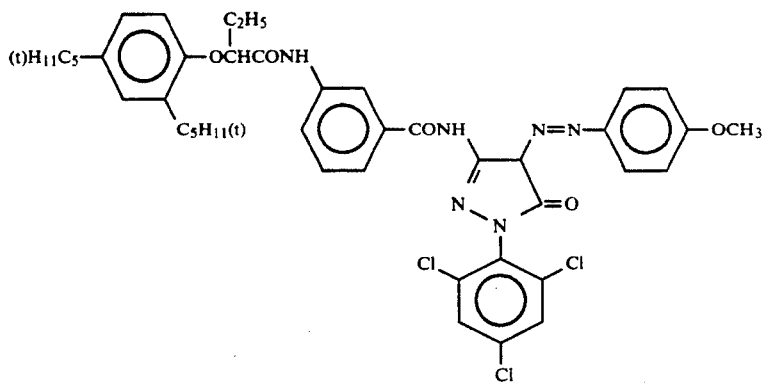
EX-2
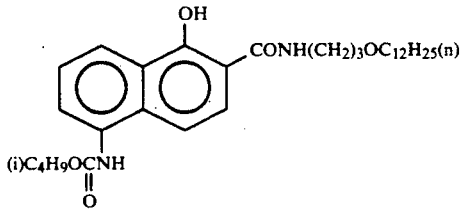
EX-3
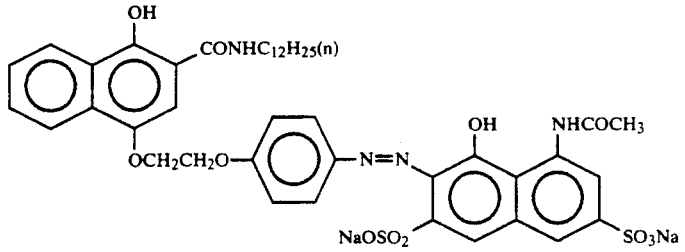
EX-4
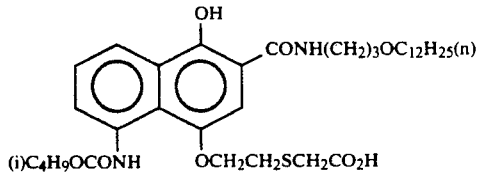
EX-5
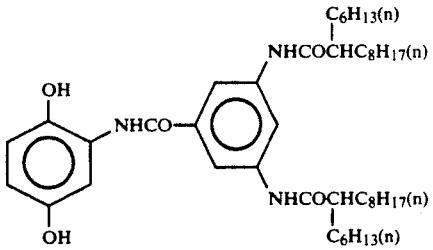
EX-6
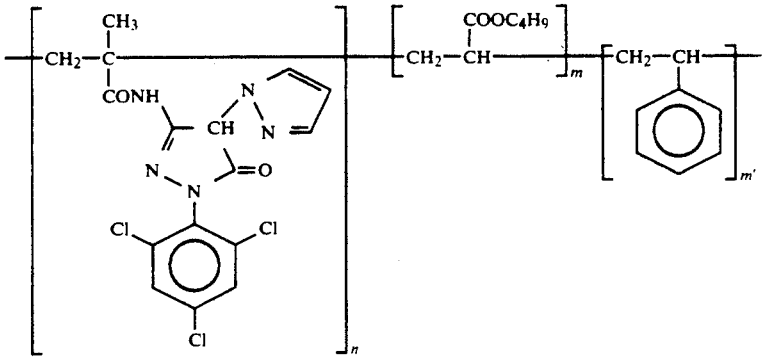

-continued
n = 50 wt%
m = 25 wt%
m' = 25 wt %
mol. wt. about 20,000
EX-7
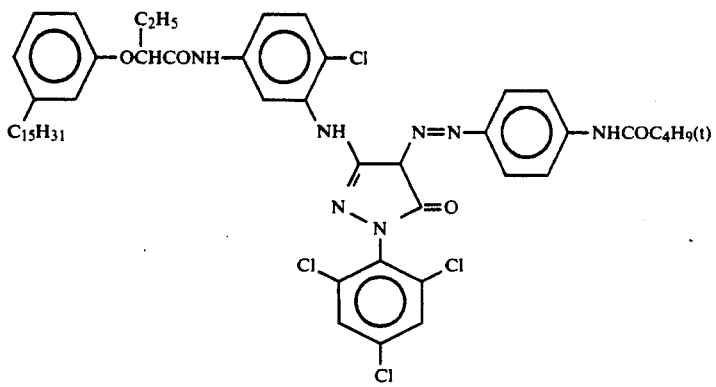
EX-8
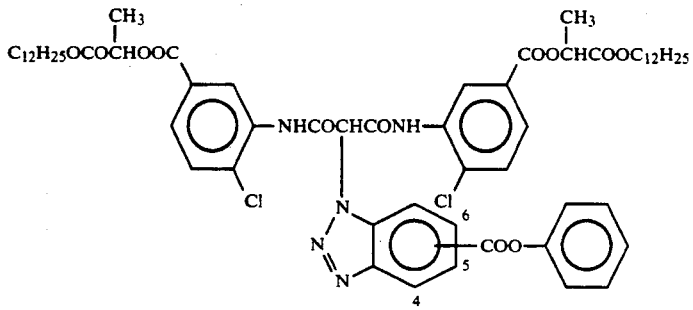
(a mixture of compounds having the substituent at 5- or 6- position)
EX-9
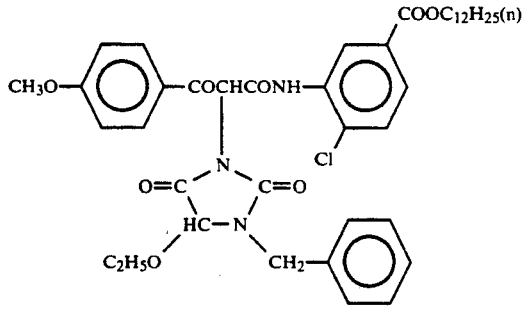
EX-10
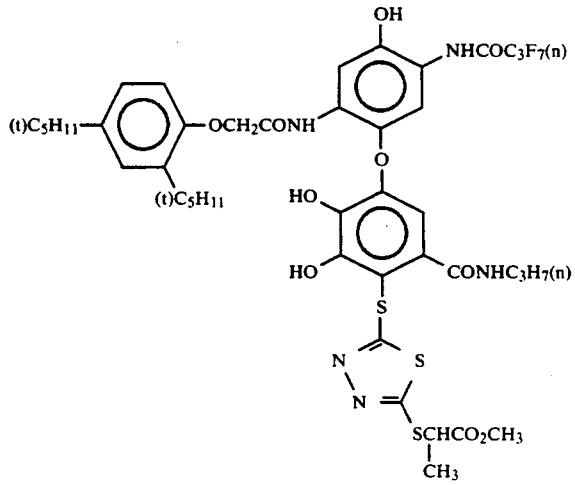

-continued
EX-11
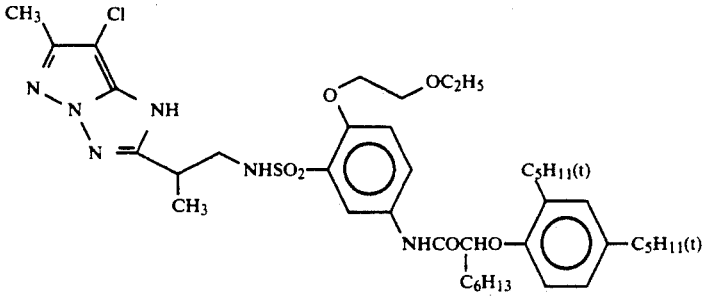
EX-12
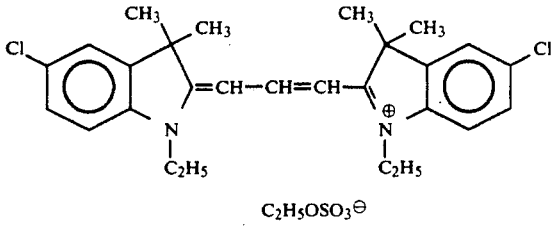
EX-13
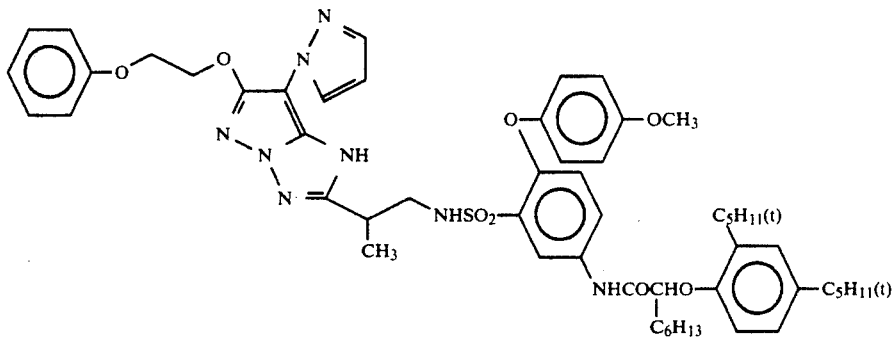
EX-14
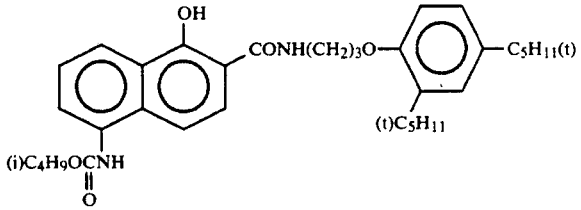
EX-15
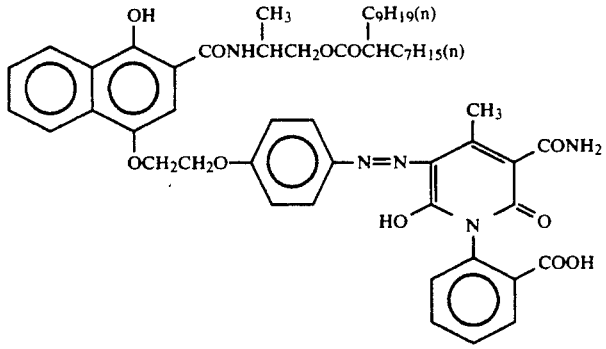
U-1
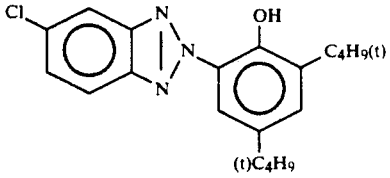
U-2
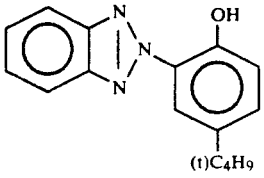

-continued
U-3
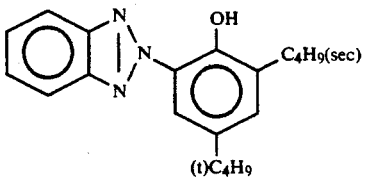
U-4
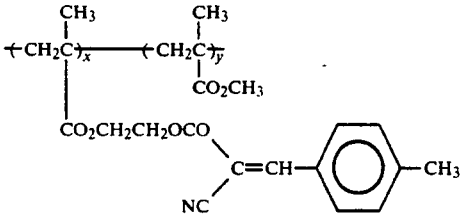
x:y = 70:30 (wt %)
U-5
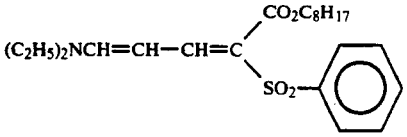
HBS-1 Tricresyl phosphate
HBS-2 Di-n-butyl phthalate
HBS-3
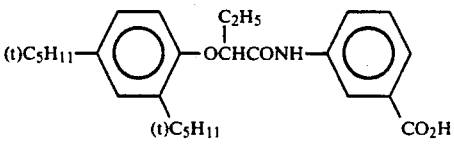
Sensitizing dye I
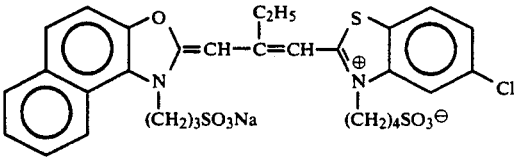
Sensitizing dye II
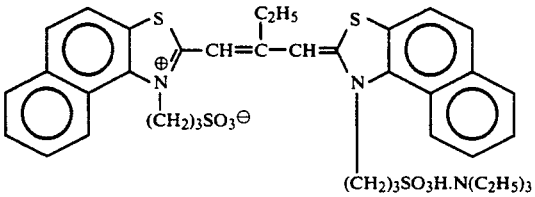
Sensitizing dye III
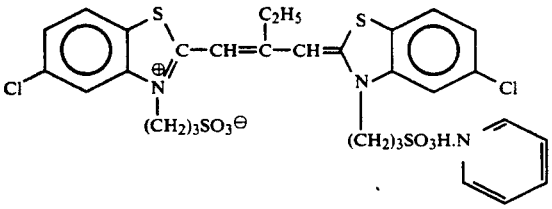
Sensitizing dye IV
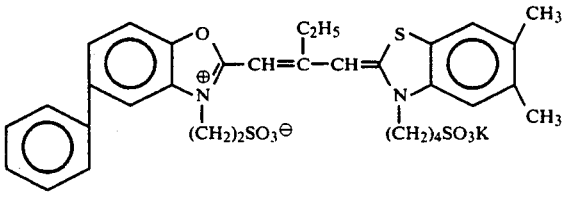
Sensitizing dye V
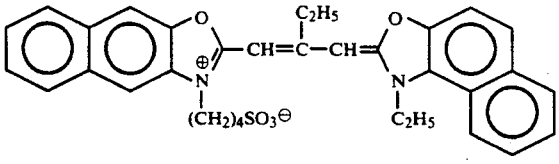
Sensitizing dye VI
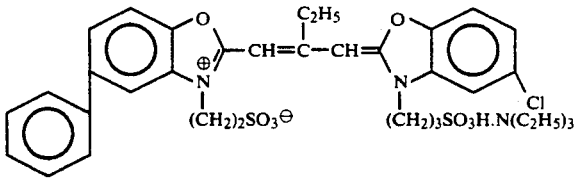
Sensitizing dye VII
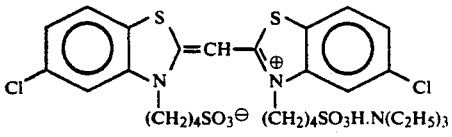
S-1
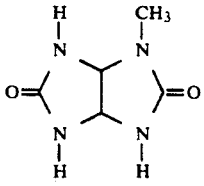
H-1
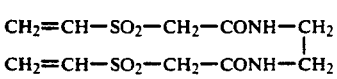
B-1
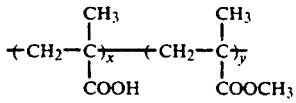
x/y = 10/90
(molar ratio)

-continued
B-2
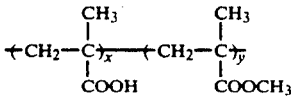
x/y = 40/60
(molar ratio)
B-3
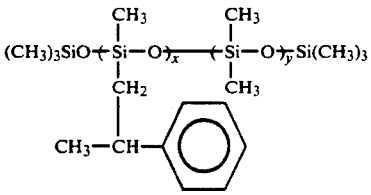
x/y = 29/46
(molar ratio)
B-4
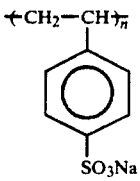
B-5
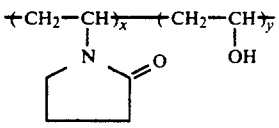
x/y = 70/30
(molar ratio)
W-1
$C_8F_{17}SO_2NHCH_2CH_2CH_2OCH_2CH_2\overset{\oplus}{N}(CH_3)_3$
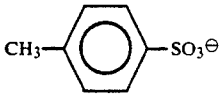
W-2
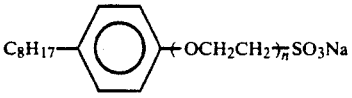
n = 2~4
W-3
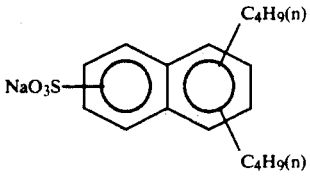
F-1
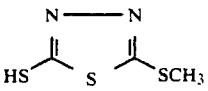
F-2
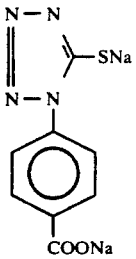
F-3
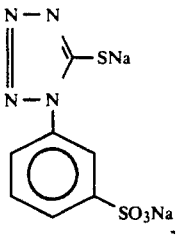
F-4
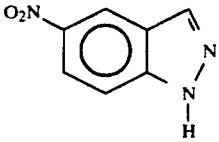
F-5
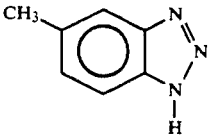
F-6
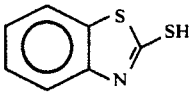
F-7
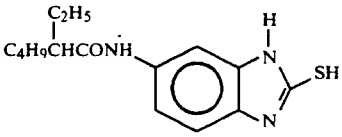

-continued

F-8 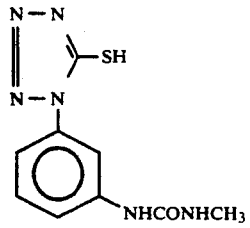

F-9 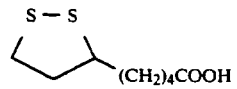

F-10 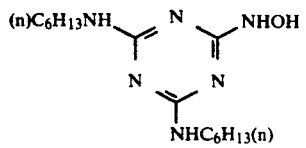

F-11 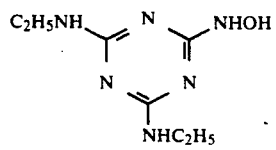

F-12 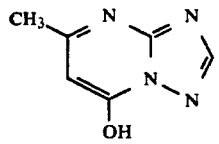

F-13 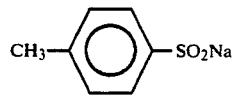

| Processing stage | Processing time | Processing temp. |
|---|---|---|
| Color development | 3 min 15 sec | 37.8° C. |
| Bleaching | 2 min 10 sec | 38.0° C. |
| Rinsing with water | 30 sec | 38.0° C. |
| Fixing | 3 min 00 sec | 38.0° C. |
| Rinse (1) | 30 sec | 30.0° C. |
| Rinse (2) | 30 sec | 30.0° C. |
| Stabilization | 1 min 05 sec | 38.0° C. |
| Drying | 2 min 00 sec | 55.0° C. |

As shown above, the processing time from the start of bleaching until just prior to drying was 7¾ minutes in this Example.

Each processing solution used in the above processing stages had the following composition.

| Color developing solution | |
|---|---|
| Water | 800 ml |
| Potassium carbonate | 32.0 g |
| Sodium bicarbonate | 1.8 g |
| Sodium sulfite | 3.8 g |
| Potassium hydroxide | 1.7 g |
| Diethylenetriaminepentaacetic acid | 1.2 g |
| 1-Hydroxyethylidene-1,1-diphosphonic acid | 2.0 g |
| Potassium bromide | 1.4 g |
| Hydroxylamine sulfate | 2.5 g |
| Potassium iodide | 0.0013 g |
| 2-Methyl-4-(N-ethyl-N-β-hydroxyethyl-amino)aniline sulfate | 4.7 g |
| Add water to make | 1000 ml |
| pH | 10.05 |
| **Bleaching solution-1 (Comparative Example)** | |
| Water | 700 ml |
| Ethylenediaminetetraacetic acid | 0.05 mol |
| Ferric chloride | 0.05 mol |
| Sodium bromide | 0.86 mol |
| Sodium nitrate | 0.38 mol |
| Acetic acid | 0.30 mol |
| Sodium hydroxide | 0.10 mol |
| pH | 4.8 |
| (pH was adjusted by adding sodium hydroxide and sulfuric acid) | |
| Add water to make | 1000 ml |

The oxidation-reduction potential of the iron (III) complex salt of ethylenediaminetetraacetic acid at a pH of 5 is 120 mV which is outside the scope of the present invention.

| Bleaching solution-2 (Comparative Example) | |
|---|---|
| Water | 700 ml |
| Methyliminodiacetic acid | 0.10 mol |
| Ferric chloride | 0.05 mol |
| Sodium bromide | 0.86 mol |
| Sodium nitrate | 0.38 mol |
| Acetic acid | 0.30 mol |
| Sodium hydroxide | 0.10 mol |
| pH | 4.8 |
| (pH was adjusted by adding sodium hydroxide and sulfuric acid) | |
| Add water to make | 1000 ml |

Methyliminodiacetic acid is outside the scope of the present invention, though the iron(III) complex salt of methyliminodiacetic acid has an oxidation-reduction potential of 285 mV at a pH of 5.

| Bleaching solution-3 (Comparative Example) | |
|---|---|
| Water | 700 ml |
| Compound 4 | 0.37 mol |
| Ferric chloride | 0.37 mol |
| Ammonium bromide | 0.86 mol |
| Ammonium nitrate | 0.38 mol |
| Acetic acid | 0.95 mol |
| Ammonia (27% aqueous solution) | 0.74 mol |
| pH | 4.8 |
| (pH was adjusted by adding sodium hydroxide and sulfuric acid) | |
| Add water to make | 1000 ml |
| **Bleaching solution-4 (Comparative Example)** | |
| Water | 700 ml |
| Compound 4 | 0.05 mol |
| Ferric chloride | 0.05 mol |
| Ammonium bromide | 0.86 mol |
| Ammonium nitrate | 0.38 mol |
| Acetic acid | 0.95 mol |
| Ammonia (27% aqueous solution) | 0.10 mol |

-continued

| | |
|---|---|
| pH | 4.8 |
| (pH was adjusted by adding sodium hydroxide and sulfuric acid) | |
| Add water to make | 1000 ml |
| Bleaching solution-5 (Comparative Example) | |
| Water | 700 ml |
| Compound 4 | 0.05 mol |
| Ferric chloride | 0.05 mol |
| Sodium bromide | 0.86 mol |
| Sodium nitrate | 0.38 mol |
| Acetic acid | 0.95 mol |
| Sodium hydroxide | 0.10 mol |
| pH | 4.8 |
| (pH was adjusted by adding sodium hydroxide and sulfuric acid) | |
| Add water to make | 1000 ml |
| Bleaching solution-6 (invention) | |
| Water | 700 ml |
| Compound 4 | 0.05 mol |
| Ferric chloride | 0.05 mol |
| Sodium bromide | 0.86 mol |
| Sodium nitrate | 0.38 mol |
| Acetic acid | 0.30 mol |
| Ammonia (27% aqueous solution) | 0.20 mol |
| pH | 4.8 |
| (pH was adjusted by adding sodium hydroxide and sulfuric acid) | |
| Add water to make | 1000 ml |
| Bleaching solution-7 (invention) | |
| Water | 700 ml |
| Compound 4 | 0.05 mol |
| Ferric chloride | 0.05 mol |
| Sodium bromide | 0.86 mol |
| Sodium nitrate | 0.38 mol |
| Acetic acid | 0.30 mol |
| Ammonia (27% aqueous solution) | 0.08 mol |
| pH | 4.8 |
| (pH was adjusted by adding sodium hydroxide and sulfuric acid) | |
| Add water to make | 1000 ml |
| Bleaching solution-8 (invention) | |
| Water | 700 ml |
| Compound 4 | 0.05 mol |
| Ferric chloride | 0.05 mol |
| Sodium bromide | 0.86 mol |
| Sodium nitrate | 0.38 mol |
| Acetic acid | 0.30 mol |
| Sodium hydroxide | 0.10 mol |
| pH | 4.8 |
| (pH was adjusted by adding sodium hydroxide and sulfuric acid) | |
| Add water to make | 1000 ml |
| Bleaching solution-9 (invention) | |
| Water | 700 ml |
| Compound 5 | 0.05 mol |
| Ferric chloride | 0.05 mol |
| Sodium bromide | 0.86 mol |
| Sodium nitrate | 0.38 mol |
| Acetic acid | 0.30 mol |
| Sodium hydroxide | 0.10 mol |
| pH | 4.8 |
| (pH was adjusted by adding sodium hydroxide and sulfuric acid) | |
| Add water to make | 1000 ml |
| Bleaching solution-10 (invention) | |
| Water | 700 ml |
| Compound 7 | 0.05 mol |
| Ferric chloride | 0.05 mol |
| Sodium bromide | 0.86 mol |
| Sodium nitrate | 0.38 mol |
| Acetic acid | 0.30 mol |
| Sodium hydroxide | 0.10 mol |
| pH | 4.8 |
| (pH was adjusted by adding sodium hydroxide and sulfuric acid) | |
| Add water to make | 1000 ml |
| Bleaching solution-11 (invention) | |
| Water | 700 ml |
| Compound 2 | 0.05 mol |
| Ferric chloride | 0.05 mol |

-continued

| | |
|---|---|
| Sodium bromide | 0.86 mol |
| Sodium nitrate | 0.38 mol |
| Acetic acid | 0.30 mol |
| Sodium hydroxide | 0.10 mol |
| pH | 4.8 |
| (pH was adjusted by adding sodium hydroxide and sulfuric acid) | |
| Add water to make | 1000 ml |
| Bleaching solution-12 (invention) | |
| Water | 700 ml |
| Compound 8 | 0.05 mol |
| Ferric chloride | 0.05 mol |
| Sodium bromide | 0.86 mol |
| Sodium nitrate | 0.38 mol |
| Acetic acid | 0.30 mol |
| Sodium hydroxide | 0.10 mol |
| pH | 4.8 |
| (pH was adjusted by adding sodium hydroxide and sulfuric acid) | |
| Add water to make | 1000 ml |
| Bleaching solution-13 (invention) | |
| Water | 700 ml |
| Compound 9 | 0.05 mol |
| Ferric chloride | 0.05 mol |
| Sodium bromide | 0.86 mol |
| Sodium nitrate | 0.38 mol |
| Acetic acid | 0.30 mol |
| Sodium hydroxide | 0.10 mol |
| pH | 4.8 |
| (pH was adjusted by adding sodium hydroxide and sulfuric acid) | |
| Add water to make | 1000 ml |
| Fixing solution | |
| Water | 700 ml |
| Disodium ethylenediaminetetraacetate | 1.7 g |
| Sodium sulfite | 14.0 g |
| Ammonium thiosulfate | 170.0 g |
| Silver bromide | 15.0 g |
| Ammonium iodide | 0.9 g |
| Add water to make | 1000 ml |
| Stabilizing solution | |
| Water | 900 ml |
| Pyrazole | 4.0 g |
| Formalin (37% formaldehyde solution) | 1.5 ml |
| Polyoxyethylene p-monononylphenyl ether (an average degree of polymerization: 10) | 0.3 g |
| Disodium ethylenediaminetetraacetate | 0.05 g |
| Add water to make | 1000 ml |
| pH | 5.8 |

The light-sensitive materials processed as described above were evaluated as follows.

The amount of residual silver and the fastness of yellow dye images to light were measured in the following manner.

The Amount of Residual Silver

The amount of silver remaining in the light-sensitive material after processing was measured by X-ray fluorometry.

Fastness to Light

The processed light-sensitive material was placed in a fluorescent tester, and the emulsion layer side thereof was continuously irradiated with light at an illuminance of 17,000 lx. for 3 days. The fading of the yellow image due to during irradiation was measured with an Exlight 310 type photographic densitometer. The fastness to light was determined by the change in yellow density.

The deposition of the crystal and the traveling of the bleaching solution upwardly along the inner walls of the bleach processing tank and the corrosion of stainless steel SUS316 were evaluated in the following manner using each of the bleaching solutions 1 to 8 prepared as described above above.

Deposition of Crystal

One liter of each the bleaching solutions 1 to 8 was put into a container having an internal dimension of 5 cm×10 cm×30 cm deep and made of polyvinyl chloride, and the container was placed in a constant temperature bath at 40° C. for one week. After the container was left to stand as described above, the deposition of the crystal on the inner wall and edges of the tank, caused by traveling of the bleaching solution upwardly along the inner walls of the tank, was observed. The evaluation was made in accordance with the following ranks.

A: No deposition was observed either on the inner wall or the edges of the tank.

B: Some deposition was observed on the inner wall, but no deposition was observed on the edges.

C: A large amount of the deposition was observed on the inner wall, and some deposition was observed on the edges.

D: A large amount of deposition was observed both on the inner wall and the edges.

In the above ranking, A is a best case and D is considered to be a worst case.

Corrosiveness 300 ml of each of the bleaching solutions 1 to 8 were put into separate 500 ml glass beakers. Three sheets of stainless steel SUS316 test pieces (5 cm×5 cm×0.2 cm thick) were piled up and joined together by means of SUS316 bolt and nut, and then immersed in the bleaching solution such that half of each strip was submersed under the bleaching solution. The beaker was placed in a constant temperature bath at 80° C. for 3 days. Thereafter, the test pieces were taken out from the bleaching solution and thoroughly washed with water. Corrosion development on the test pieces was visually observed, and the following ranking was made.

A: No corrosion observed.

B: Fine pinholes were locally found.

C: Pinholes were widely formed.

D: Pinholes were widely formed, and red rust was also formed.

In the above rankings, A is the best case and D is considered to be the worst case.

The results are shown in Table 2.

It is seen from Table 2 that when processed in the bleaching solution 3 of the Comparative Example, desilverization is good, but properties with regard to fastness to light, deposition of the crystal and corrosiveness are very poor. In the bleaching solution 4 wherein the concentration of the iron(III) complex salt of the organic acid in the bleaching solution 3 was reduced to 0.05 mol/l, fastness to light was slightly improved, but desilverization was remarkably deteriorated and properties with regard to deposition of the crystal and corrosiveness were still poor. In the bleaching solution 5 wherein the concentration of ammonium ion in the bleaching solution 4 was reduced to the value within the scope of the present invention, no improvement was seen because the concentration of acetic acid was outside the scope of the present invention. In the bleaching solutions 1 and 2 wherein the iron(III) complex salt of an organic acid outside the scope of the present invention was used, desilverization was insufficient, even though the concentration of the iron(III) complex salt of the organic acid, that of ammonium ion and that of acetic acid were adjusted to values within the scope of the present invention.

On the other hand, a remarkable improvement was obtained by processing in the bleaching solutions 6 to 13 of the present invention. It is clearly seen that the effects of the present invention are obtained only when the bleaching solution contains an iron(III) complex salt of the specific organic acid of the present invention, and the concentration thereof and the concentrations of ammonium ion and the acid having a pKa of 2 to 5.5 (e.g., acetic acid) are within the scope of the present invention. In other words, the effects of the present invention are obtained only when the characteristic features of the invention are satisfied.

An amount of residual silver of not more than 5 $\mu g/cm^2$ is generally acceptable. Accordingly, all of the bleaching agents of the present invention are satisfactory with regard to desilverization.

EXAMPLE 2

The sample 201 (a color negative light-sensitive material) of Example 2 of JP-A-2-90151 was cut into specimens of 35 mm in width, exposed to light (overall exposure) of 20 CMS at a color temperature of 4800 K and processed in a cine type automatic processor by using the following processing solutions in the following stages.

TABLE 2

| Bleaching solution | Iron complex salt | $NH_4^+$ | Acetic acid | Residual silver | Fastness to light | Deposition of crystal | Corrosiveness | Remarks |
|---|---|---|---|---|---|---|---|---|
| 1 | 0.05 | 0.0 | 0.3 | 95.6 | 0.15 | B | A | Comp. Ex. |
| 2 | 0.05 | 0.0 | 0.3 | 52.3 | 0.27 | B | A | Comp. Ex. |
| 3 | 0.37 | 1.98 | 0.95 | 2.6 | 0.33 | D | D | Comp. Ex. |
| 4 | 0.05 | 1.34 | 0.95 | 28.7 | 0.24 | C | C | Comp. Ex. |
| 5 | 0.05 | 0.0 | 0.95 | 30.2 | 0.22 | B | C | Comp. Ex. |
| 6 | 0.05 | 0.2 | 0.3 | 2.8 | 0.14 | B | A | Invention |
| 7 | 0.05 | 0.08 | 0.3 | 2.8 | 0.13 | B | A | Invention |
| 8 | 0.05 | 0.0 | 0.3 | 2.9 | 0.11 | A | A | Invention |
| 9 | 0.05 | 0.0 | 0.3 | 0.9 | 0.09 | A | A | Invention |
| 10 | 0.05 | 0.0 | 0.3 | 1.4 | 0.12 | A | A | Invention |
| 11 | 0.05 | 0.0 | 0.3 | 3.1 | 0.15 | B | A | Invention |
| 12 | 0.05 | 0.0 | 0.3 | 1.1 | 0.17 | A | B | Invention |
| 13 | 0.05 | 0.0 | 0.3 | 1.4 | 0.91 | A | B | Invention |

Iron complex salt, $NH_4^+$ and acetic acid in Table 2 represent the molar concentration in the bleaching solution of the iron(III) complex salt of an organic acid, ammonium ion and acetic acid (an acid having a pKa of from 2 to 5.5), respectively. The unit of each of these concentrations is mol/l.

The unit of the amount of residual silver is $\mu g/cm^2$, and a residual amount of not more than 5 $\mu g/cm^2$ indicates that disilverization is acceptable for practical use.

Bleaching solutions 14 to 24 including comparative bleaching solutions and those of the invention were prepared, and processing was carried out by replacing the bleaching solution with one another in turn.

| Processinq stage | Processing time | Processing temp. |
|---|---|---|
| Color development | 2 min 50 sec | 39.0° C. |
| Bleaching | 1 min 45 sec | 38.0° C. |
| Fixing | 2 min 30 sec | 38.0° C. |
| Rinse with water (1) | 30 sec | 30.0° C. |
| Rinse with water (2) | 30 sec | 30.0° C. |
| Stabilization | 40 sec | 38.0° C. |
| Drying | 1 min 15 sec | 60.0° C. |

As shown above, the processing time after completion of bleaching until just prior to drying was 5 minutes and 55 seconds.

Each processing solution used in the above processing stages had the following composition.

| Color developing solution | |
|---|---|
| Water | 800 ml |
| Potassium carbonate | 32.0 g |
| Sodium bicarbonate | 1.8 g |
| Sodium sulfite | 3.8 g |
| Potassium hydroxide | 1.8 g |
| Diethylenetriaminepentaacetic acid | 2.0 g |
| Potassium bromide | 1.5 g |
| Hydroxylamine sulfate | 2.5 g |
| Potassium iodide | 0.0015 g |
| 2-Methyl-4-(N-Methyl-N-β-hydroxyethylamino)aniline sulfate | 5.0 g |
| Add water to make | 1000 ml |
| pH | 10.08 |
| Bleaching solution-14 (Comparative Example) | |
| Water | 700 ml |
| Diethylenetriaminepentaacetic acid | 0.05 mol |
| Ferric chloride | 0.05 mol |
| Potassium bromide | 0.50 mol |
| Sodium nitrate | 0.30 mol |
| Glycolic acid | 0.20 mol |
| Sodium hydroxide | 0.10 mol |
| pH | 4.5 |
| (pH was adjusted by adding sodium hydroxide and sulfuric acid) | |
| Add water to make | 1000 ml |

The oxidation-reduction potential of the iron (III) complex salt of diethylenetriaminepentaacetic acid at a pH of 5 is 105 mV which is outside the scope of the present invention.

| Bleaching solution-15 (Comparative Example) | |
|---|---|
| Water | 700 ml |
| Nitrilotriacetic acid | 0.10 mol |
| Ferric chloride | 0.05 mol |
| Potassium bromide | 0.50 mol |
| Sodium nitrate | 0.30 mol |
| Glycolic acid | 0.20 mol |
| Sodium hydroxide | 0.10 mol |
| pH | 4.5 |
| (pH was adjusted by adding sodium hydroxide and sulfuric acid) | |
| Add water to make | 1000 ml |

The iron(III) complex salt of nitrilotriacetic acid has an oxidation-reduction potential of 175 mV at a pH of 5 and only one nitrogen atom per molecule, and hence this compound is outside the scope of the present invention.

| Bleaching solution-16 (Comparative Example) | |
|---|---|
| Water | 700 ml |
| Compound 4 | 0.20 mol |
| Ferric chloride | 0.20 mol |
| Potassium bromide | 0.50 mol |
| Sodium nitrate | 0.30 mol |
| Glycolic acid | 0.20 mol |
| Sodium hydroxide | 0.40 mol |
| pH | 4.5 |
| (pH was adjusted by adding sodium hydroxide and sulfuric acid) | |
| Add water to make | 1000 ml |
| Bleaching solution-17 (invention) | |
| Water | 700 ml |
| Compound 4 | 0.08 mol |
| Ferric chloride | 0.08 mol |
| Potassium bromide | 0.50 mol |
| Sodium nitrate | 0.30 mol |
| Glycolic acid | 0.20 mol |
| Sodium hydroxide | 0.16 mol |
| pH | 4.5 |
| (pH was adjusted by adding sodium hydroxide and sulfuric acid) | |
| Add water to make | 1000 ml |
| Bleaching solution-18 (invention) | |
| Water | 700 ml |
| Compound 4 | 0.03 mol |
| Ferric chloride | 0.03 mol |
| Potassium bromide | 0.50 mol |
| Sodium nitrate | 0.30 mol |
| Glycolic acid | 0.20 mol |
| Sodium hydroxide | 0.06 mol |
| pH | 4.5 |
| (pH was adjusted by adding sodium hydroxide and sulfuric acid) | |
| Add water to make | 1000 ml |
| Bleaching solution-19 (invention) | |
| Water | 700 ml |
| Compound 4 | 0.01 mol |
| Ferric chloride | 0.01 mol |
| Potassium bromide | 0.50 mol |
| Sodium nitrate | 0.30 mol |
| Glycolic acid | 0.20 mol |
| Sodium hydroxide | 0.02 mol |
| pH | 4.5 |
| (pH was adjusted by adding sodium hydroxide and sulfuric acid) | |
| Add water to make | 1000 ml |
| Bleaching solution-20 (Comparative Example) | |
| Water | 700 ml |
| Compound 4 | 0.005 mol |
| Ferric chloride | 0.005 mol |
| Potassium bromide | 0.50 mol |
| Sodium nitrate | 0.30 mol |
| Glycolic acid | 0.20 mol |
| Sodium hydroxide | 0.01 mol |
| pH | 4.5 |
| (pH was adjusted by adding sodium hydroxide and sulfuric acid) | |
| Add water to make | 1000 ml |
| Bleaching solution-21 (Comparative Example) | |
| Water | 700 ml |
| Ethylenediaminetetraacetic acid | 0.03 mol |
| Compound 5 | 0.02 mol |
| Ferric chloride | 0.05 mol |
| Potassium bromide | 0.50 mol |
| Sodium nitrate | 0.30 mol |
| Glycolic acid | 0.20 mol |
| Sodium hydroxide | 0.10 mol |
| pH | 4.5 |
| (pH was adjusted by adding sodium hydroxide and sulfuric acid) | |
| Add water to make | 1000 ml |
| Bleaching solution-22 (Invention) | |
| Water | 700 ml |
| Ethylenediaminetetraacetic acid | 0.02 mol |
| Compound 5 | 0.03 mol |

-continued

| | |
|---|---|
| Ferric chloride | 0.05 mol |
| Potassium bromide | 0.50 mol |
| Sodium nitrate | 0.30 mol |
| Glycolic acid | 0.20 mol |
| Sodium hydroxide | 0.10 mol |
| pH | 4.5 |
| (pH was adjusted by adding sodium hydroxide and sulfuric acid) | |
| Add water to make | 1000 ml |
| Bleaching solution-23 (Invention) | |
| Water | 700 ml |
| Ethylenediaminetetraacetic acid | 0.01 mol |
| Compound 5 | 0.04 mol |
| Ferric chloride | 0.05 mol |
| Potassium bromide | 0.50 mol |
| Sodium nitrate | 0.30 mol. |
| Glycolic acid | 0.20 mol |
| Sodium hydroxide | 0.10 mol |
| pH | 4.5 |
| (pH was adjusted by adding sodium hydroxide and sulfuric acid) | |
| Add water to make | 1000 ml |
| Bleaching solution-24 (Invention) | |
| Water | 700 ml |
| Compound 5 | 0.05 mol |
| Ferric chloride | 0.05 mol |
| Potassium bromide | 0.50 mol |
| Sodium nitrate | 0.30 mol |
| Glycolic acid | 0.20 mol |
| Sodium hydroxide | 0.10 mol |
| pH | 4.5 |
| (pH was adjusted by adding sodium hydroxide and sulfuric acid) | |
| Add water to make | 1000 ml |
| Fixing solution | |
| Water | 700 ml |
| Disodium ethylenediaminetetraacetate | 1.7 g |
| Ammonium sulfite | 14.0 g |
| Ammonium thiosulfate | 190.0 g |
| Silver bromide | 13.0 g |
| Imidazole | 15.0 g |
| Ammonium iodide | 1.0 g |
| Add water to make | 1000 ml |
| Stabilizing solution | |
| Water | 900 ml |
| Pyrazole | 4.0 g |
| Formalin (37% formaldehyde solution) | 1.5 ml |
| Hexamethylenetetramine | 0.5 g |
| Polyoxyethylene p-monononylphenyl ether (a degree of polymerization: 10) | 0.3 g |
| Disodium ethylenediaminetetraacetate | 0.05 g |
| Add water to make | 1000 ml |
| pH | 6.0 |

In the same manner as in Example 1, the light-sensitive materials processed as described above were evaluated with respect to residual silver, fastness of the yellow dye image to light, deposition of crystal on the processing tank wall and stainless steel corrosion were evaluated. The results are shown in Table 3.

TABLE 3

| Bleaching solution | Iron complex salt | Ratio | Glycolic acid | Amount of residual silver | Fastness to light | Deposition of crystal | Corrosiveness | Remarks |
|---|---|---|---|---|---|---|---|---|
| 14 | 0.05 | 100 | 0.2 | 87.2 | 0.18 | B | A | Comp. Ex. |
| 15 | 0.05 | 100 | 0.2 | 44.6 | 0.25 | B | C | Comp. Ex. |
| 16 | 0.20 | 100 | 0.2 | 1.5 | 0.27 | D | C | Comp. Ex. |
| 17 | 0.08 | 100 | 0.2 | 1.7 | 0.15 | B | A | Invention |
| 18 | 0.03 | 100 | 0.2 | 3.3 | 0.11 | A | A | Invention |
| 19 | 0.01 | 100 | 0.2 | 4.5 | 0.12 | A | A | Invention |
| 20 | 0.005 | 100 | 0.2 | 26.6 | 0.23 | A | A | Comp. Ex. |
| 21 | 0.05 | 40 | 0.2 | 10.9 | 0.17 | B | A | Comp. Ex. |
| 22 | 0.05 | 60 | 0.2 | 3.9 | 0.13 | B | A | Invention |
| 23 | 0.05 | 80 | 0.2 | 2.4 | 0.10 | A | A | Invention |
| 24 | 0.05 | 100 | 0.2 | 1.1 | 0.09 | A | A | Invention |

Iron complex salt and glycolic acid in Table 3 represent the molar concentration in the bleaching solution of the iron(III) complex salt of an organic acid and that of glycolic acid (an acid having a pKa of from 2 to 5.5), respectively. The unit of each of these concentrations is mol/l.

The ratio represents percentage by mol of the iron(III) complex salt of an organic acid having an oxidation-reduction potential of not less than 200 mV at a pH of 5 based on the entire content (by mol) of the iron(III) complex salt of an organic acid.

The unit of the amount of residual silver is $\mu g/cm^2$.

It is seen from Table 3 that effects of the present invention are obtained when the iron (III) complex salt of the specific organic acid of the present invention is contained in the bleaching solution at a concentration of from 0.01 mol/l to less than 0.1 mol/l. Furthermore it is clearly seen that at least 50 mol % of the entire content of the iron(III) complex salt of an organic acid must be the iron(III) complex salt of the specific organic acid of the present invention.

No bleach fog was observed on the light-sensitive materials processed according to the present invention.

According to the present invention, the desilverization treatment can be carried out rapidly, At the same time, fastness of yellow dye images to light is improved, the deposition of crystal on the walls of the bleach processing tank is prevented, and stainless steel parts in contact with the bleaching solution are not corroded. Furthermore, bleach fog is not formed. On the other hand, bleach fog generally occurs when conventional bleaching agents having a high oxidation-reduction potential are used. Furthermore, since the concentration of the iron(III) complex salt of an organic acid and that of ammonium ion in the bleaching solution are relatively low, the amount of these compounds discharged as waste is reduced. Hence the present invention presents a reduced burden to the environment, while providing excellent desilvering performance.

While the invention has been described in detail and with reference to specific embodiments thereof, it will be apparent to one skilled in the art that various changes and modifications can be made therein without departing from the spirit and scope thereof.

What is claimed is:

1. A method for processing an image-wise exposed silver halide color photographic material comprising a support having thereon at least one light-sensitive silver halide emulsion layer, comprising the steps of developing in a color developing solution and bleaching in a bleaching solution, wherein the bleaching solution comprises:

(a) an iron(III) complex salt of an organic acid (1) with a concentration of from 0.01 mol/l to less than 0.08 mol/l, (2) with at least 50 mol % having an oxidation-reduced potential of not lower than 200 mV determined by using a normal hydrogen electrode at pH 5.0 (excluding iron(III) complex salts of iminodiacetic acid and iron(III) complex salts of methyliminodiacetic acid), and (b) an acid having a pKa of from 2 to 5.5 (excluding aminopolycarboxylic acids, salts thereof and iron complex salts of the aminopolycarboxylic acids) in a concentration of from 0.1 mol/l to 0.8 mol/l, and the concentration of ammonium ion in the bleaching solution is not higher than 0.3 mol/l.

2. The method as in claim 1, wherein at least 50 mol % of the iron(III) complex salt of an organic acid contained in the bleaching solution is an iron(III) complex salt of an organic acid having an oxidation-reduction potential of from 200 mV to 400 mV.

3. The method as in claim 1, wherein the concentration of the iron(III) complex salt of an organic acid contained in the bleaching solution is from 0.01 mol/l to 0.08 mol/l.

4. The method as in claim 1, wherein at least 80 mol % of the iron(III) complex salt of an organic acid contained in the bleaching solution is an iron(III) complex salt of an organic acid having an oxidation-reduction potential of not lower than 200 mV.

5. The method as in claim 1, wherein all of the iron(III) complex salt of an organic acid contained in the bleaching solution is an iron(III) complex salt of an organic acid having an oxidation-reduction potential of not lower than 200 mV.

6. The method as in claim 1, wherein the concentration of the acid having a pKa of from 2 to 5.5 in the bleaching solution is from 0.1 mol/l to 0.5 mol/l.

7. The method as in claim 1, wherein the concentration of ammonium ion in the bleaching solution is less than 0.1 mol/l.

8. The method as in claim 1, wherein the bleaching solution is completely free from ammonium ion.

9. The method as in claim 1, wherein the bleaching solution has a pH of from 3.0 to 5.5.

10. The method as in claim 1, wherein the organic acid which comprises the iron(III) complex salt of an organic acid having an oxidation-reduction potential of not lower than 200 mV is selected from the group consisting of Compounds 1 to 10:

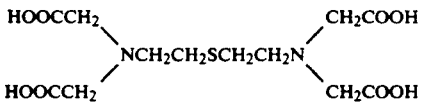
Compound 1

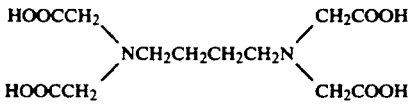
Compound 2

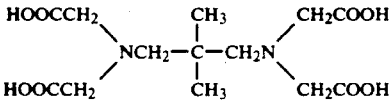
Compound 3

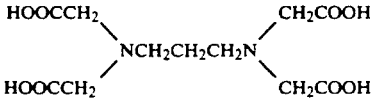
Compound 4

-continued

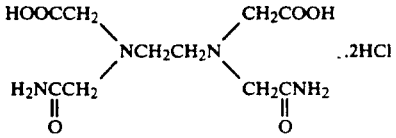
Compound 5

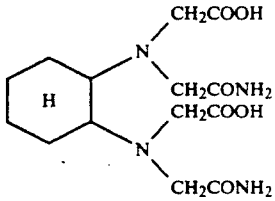
Compound 6

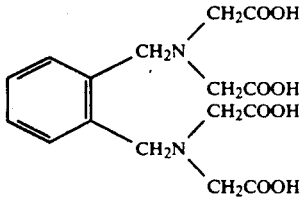
Compound 7

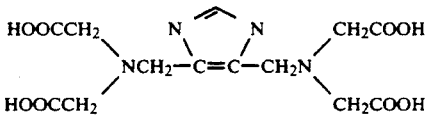
Compound 8

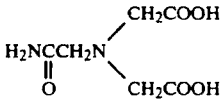
Compound 9 and

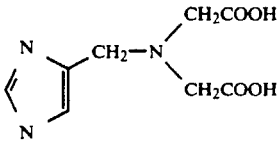
Compound 10

11. The method as in claim 1, wherein the iron(III) salt which comprises the iron(III) complex salt of an organic acid is selected from the group consisting of ferric chloride, ferric sulfate and ferric bromide.

12. The method as in claim 2, wherein at least 50 mol % of the iron(III) complex salt of an organic acid contained in the bleaching solution is an iron(III) complex salt of an organic acid having an oxidation-reduction potential of from 240 mV to 400 mV.

13. The method as in claim 12, wherein at least 50 mol % of the iron(III) complex salt of an organic acid contained in the bleaching solution is an iron(III) complex salt of an organic acid having an oxidation-reduction potential of from 260 mV to 350 mV.

14. The method as in claim 1, wherein said acid having a pKa of from 2 to 5.5 is selected from acids consisting of acetic acid, glycolic acid and lactic acid.

15. The method as in claim 1, wherein the method further comprises wet processing for fixing and rinsing and drying the photographic material, wherein the wet processing time after completion of bleaching to the start of drying is 10 minutes or less.

* * * * *